US007524411B2

(12) United States Patent
Doerksen

(10) Patent No.: US 7,524,411 B2
(45) Date of Patent: Apr. 28, 2009

(54) ALTERNATE COKE FURNACE TUBE ARRANGEMENT

(75) Inventor: Brian Jay Doerksen, Ponca City, OK (US)

(73) Assignee: ConocoPhillips Company, Houston, TX (US)

( * ) Notice: Subject to any disclaimer, the term of this patent is extended or adjusted under 35 U.S.C. 154(b) by 632 days.

(21) Appl. No.: 11/006,878

(22) Filed: Dec. 8, 2004

(65) Prior Publication Data

US 2005/0098477 A1 May 12, 2005

Related U.S. Application Data

(62) Division of application No. 09/872,390, filed on Jun. 1, 2001, now Pat. No. 6,852,294.

(51) Int. Cl.
*C10G 9/14* (2006.01)

(52) U.S. Cl. ..... 208/132; 208/131; 208/50

(58) Field of Classification Search ..... 208/132, 208/131, 50

See application file for complete search history.

(56) References Cited

U.S. PATENT DOCUMENTS

| | | | |
|---|---|---|---|
| 2,179,080 | A | 11/1939 | Alther |
| 3,112,880 | A | 12/1963 | Pollock |
| 3,353,920 | A | 11/1967 | Kitzen |
| 3,365,387 | A | 1/1968 | Chan et al. |
| 4,008,128 | A | 2/1977 | Dorner |
| 4,049,538 | A | 9/1977 | Hayashi et al. |
| 4,180,019 | A | 12/1979 | O'Sullivan et al. |
| 4,547,284 | A | 10/1985 | Sze et al. |
| 5,078,857 | A | 1/1992 | Melton |
| 5,394,837 | A | 3/1995 | Tsai et al. |
| 5,687,678 | A | 11/1997 | Suchomel et al. |
| 5,697,435 | A | 12/1997 | Stickford, Jr. et al. |
| 6,237,545 | B1 | 5/2001 | Barnett et al. |
| 6,241,855 | B1 | 6/2001 | Gibson et al. |
| 6,264,798 | B1 | 7/2001 | Gibson et al. |

FOREIGN PATENT DOCUMENTS

| | | |
|---|---|---|
| GB | 487356 | 6/1938 |

*Primary Examiner*—Tam M Nguyen

(57) ABSTRACT

Tubes within a radiant heating section of a coking furnace are arranged differently than in a single vertical column and connected together in a simple, planar serpentine pattern. The tubes are arranged in a plurality of offset or staggered vertical columns. This arrangement permits the upper tubes to be close to the radiant heat source and also allows the tube bends connecting adjacent tubes to be of greater radius, so that the pressure at which the feedstock is passed through the tube bundle can be lower allowing more vaporization of the cracked process fluids.

7 Claims, 3 Drawing Sheets

ALTERNATE COKE FURNACE TUBE ARRANGEMENT

CROSS REFERENCE TO RELATED APPLICATION

This is a divisional application of U.S. patent application Ser. No. 09/872,390 of Brian Jay Doerksen for "Alternate Coke Furnace Tube Arrangement " filed Jun. 1, 2001 now U.S. Pat. No. 6,852,294, which is incorporated herein by reference.

FIELD OF THE INVENTION

The present invention relates to apparatus and processes for heating feedstocks in cracking heaters, and more particularly relates, in one embodiment, to apparatus for heating feedstocks in delayed coking processes by radiant heating. In a more particular aspect the present invention relates, in another embodiment, to a heater for use in heating the coking feedstock that is introduced into the coking drum in a delayed coking process and a novel coke furnace tube configuration.

BACKGROUND OF THE INVENTION

It is well known that coking is a severe thermal cracking process in which one of the end products comprises carbon, i.e. coke. The delayed coking process was initially developed to minimize refinery yields of residual fuel oil by severe cracking of feedstocks such as vacuum residuals and thermal tars to produce coke and lower molecular weight hydrocarbons. U.S. Pat. Nos. 4,049,538 and 4,547,284, the disclosures of which are incorporated herein by reference, show examples of delayed coking processes.

It is also well recognized that the delayed coking process generally involves heating the feedstock in the conduit or tubing of a tube heater to a temperature above the cracking temperature while feeding the feedstock at a high velocity through the conduit. The optimum operation involves the use of feed rate such as to minimize the actual formation of carbon in the heated conduit of the tube heater. The tube heaters are often referred to interchangeably as coker heaters or coker preheaters and the terms are similarly used interchangeably in this description.

In U.S. Pat. No. 4,049,538 a coker preheater is illustrated diagrammatically as item number 11. In U.S. Pat. No. 4,547,284 a coker heater is illustrated diagrammatically as item number 25. The heated feedstock at the coking temperature is passed from the heating zone to a coke drum wherein preferably the majority of the coke formation takes place. In the insulated coke drum, or surge drum, a sufficient residence time allows the coking to take place. Typically, the heated coking feedstock has been heated to a temperature sufficient to maintain the coking in the drum, i.e. temperature in the range of about 750 to about 975° F. (399 to 524° C.). As the process proceeds, coke accumulates in the coking drum and is later removed by techniques known in the art.

Although much effort has been devoted in the past to providing conditions that will allow for the delayed coking feedstock to be heated to the cracking temperature without the formation of undesirable carbon deposits in the conduits or tubes of the coker heater, carbon deposition in the conduits of the coker heater still continues to be a problem.

As coke deposits in the conduit of the tube heater, the flow of feedstock through the heater is restricted. The restriction of flow can lead to increased residence time that in turn can lead to the deposition of additional coke. The coke deposits in turn tend to insulate the tube so that more heat must be applied to achieve the same rate of heating of the feedstock. In addition, the coke deposits cause the tubes to become much hotter. All these factors obviously tend to encourage the formation of still more coke within the tube of the tube heater further exacerbating the problem.

If the temperature of the tube increases enough, a tube rupture can occur. The likelihood of tube rupture is also aggravated by the fact that the feed must be pumped at ever-higher pressures as the flow is restricted by coke deposition in the tubes of the heater. The combination of exposing the tubes to higher temperatures and higher pressures greatly increases the probability of tube rupture and total shut down of the delayed coking process.

Because of the formation of coke deposits in the tubes of the heaters, operators of coke furnaces in the past have had to periodically shut down the operation and remove the coke that had been formed within the tubes of the heater.

It would be desirable if a cracking heater such as a coke furnace could be devised to minimize coke deposition within the heater tubes and increase the efficiency with which the feedstock in those tubes is heated. If such a furnace could be devised which additionally has reduced volume, this additional characteristic would be advantageous.

Figure 1:
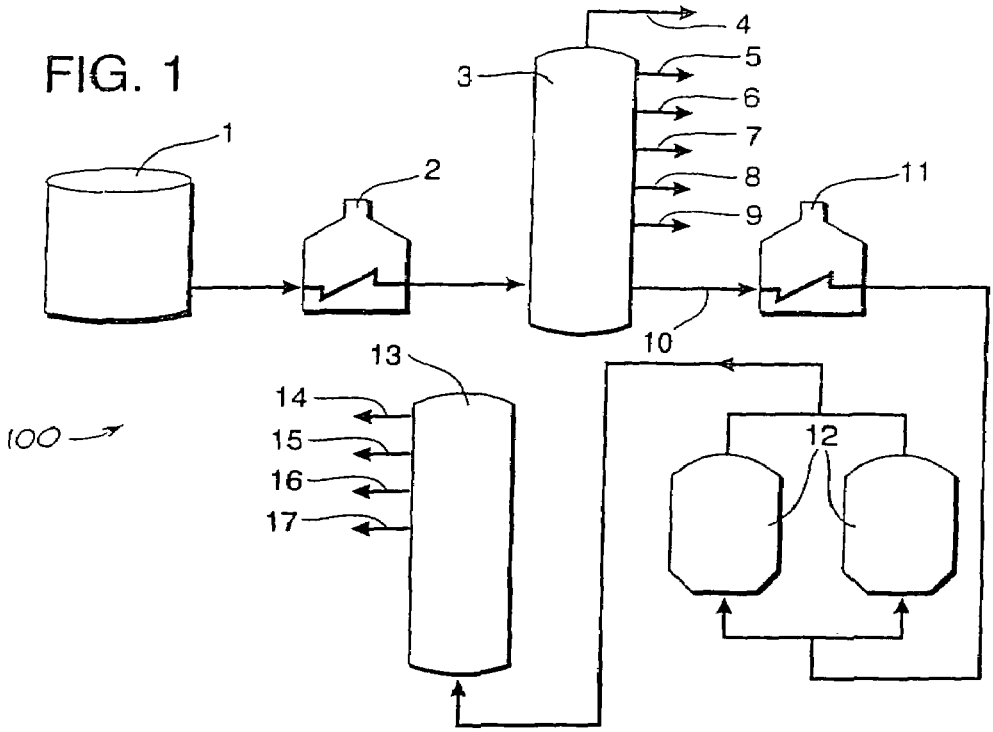
FIG. 1 is a typical schematic diagram of the refining process including a coker.

It will be appreciated that the Figures are not necessarily to scale and that certain features are exaggerated to show detail, unless otherwise noted. It is also appreciated that any equipment not directly or critically related to the present invention is not shown in the drawings.

SUMMARY OF THE INVENTION

Accordingly, it is an object of the present invention to provide an improved delayed coking process in which the tendency for coke to be deposited in the tubes of the coke heater is greatly reduced.

It is another object of the present invention to provide a more efficient coke heater for a delayed coking process. A related object of the invention is to provide a coke heater that allows for a reduced residence time of the coking feedstock in the heater.

Still another object of the invention is to provide a coke heater that can be operated for extended periods of time without having to be taken off-line for coke removal.

Another object of the invention is to provide a coke heater that can provide the desired level of heating with a coke furnace of less overall height.

In carrying out these and other objects of the invention, there is provided, in one form, a cracking heater that has an enclosed housing including a substantially parallel front and back, a pair of substantially parallel sides which are perpendicular to the front and back and a top and bottom providing a continuous enclosure, at least one heat source, and an exhaust duct. The cracking heater also has a tube bundle including a plurality of continuous horizontal tubes parallel to the pair of sides, where the horizontal tubes are sequentially linked together by a plurality of tube bends and where at least a portion of the tubes are arranged in a plurality of vertical columns and are horizontally offset from one another. A feedstock is carried through the tubes beginning at a first end of the tube bundle and exiting at a second end of the tube bundle.

DETAILED DESCRIPTION OF THE INVENTION

It has been discovered that by staggering the tubes in a coking furnace, particularly a double-fired coker heater, that a number of advantages may be obtained. Coking furnaces or coker heaters are peculiar in refining operations. Factors such as heat flux patterns, coke deposition, vaporization of the cracked liquid fluid as it passes through the tubes, and retention time in the heater coil tubes above critical coking temperatures all have tremendous impact on the success of operations.

It will be appreciated that the invention is not limited to the arrangement of tubes in a coking furnace but could be applied to and used in any cracking heater. Cracking heaters may include, but are not necessarily limited to, coking furnaces, thermal crackers, ethylene crackers, visbreakers, and the like. Although the invention will be described herein with particular reference to coking furnaces, it will be understood that this is only for the purpose of illustrating the invention with respect to a particular, concrete embodiment, and does not necessarily limit the scope of the invention.

In a further particular embodiment of the invention, it will be appreciated that the invention will find its greatest utility in the radiant heating portion of a cracking heater. By radiant heating portion it should be understood that the primary method of heat transfer is by radiation as contrasted with other methods, such as by convection. Stated another way, the inventive apparatus and process are best practiced in a portion of a cracking heater where the primary method of heat transfer is by radiation and not convection.

It has been discovered that staggering the tube columns in various parts of the coking furnace, particularly the radiant tube section of a double-fired coker heater permits manipulation of the heat flux between groups of tubes. For instance, upper tubes in a radiant section farther from the burners often have conduction as the main heat transfer mechanism, rather than radiant heat transfer. Staggering the orientation of the upper tubes can bring them lower in the furnace so that more of the heat transfer to these tubes is radiant. As a result, more heat duty would be picked up by these lowered tubes and in which the fluid has not yet reached temperatures at which coke is rapidly deposited. If more heat is picked up in the upper radiant section that is less prone to coking, the furnace would not have to be fired as strongly, and the outlet tubes which have a greater tendency to coke deposition have a lower heat flux—thus decreasing the rate of coking.

Staggering the tubes in some portions of the radiant heat section and not in others permits manipulation of critical peak to average heat flux around the diameter of the tubes. For instance, by positioning the tubes according to the method of the invention, one can take advantage of the benefits of a staggered design in sections where slightly higher peak to average flux is not a difficulty, and reverting to the conventional single straight column in sections where analysis finds it to be more important. Thus, the staggering pattern of the instant invention permits flexibility of design and more design control for the designers.

Staggering the tubes according to the present invention also permits the use of longer radius return bends in the same heater configuration, thus reducing pressure drop through otherwise equivalent tube banks or bundles. In one non-limiting embodiment of the invention, 4 inch (10 cm) nominal long radius tube bends have a radius of twelve (12) inches or greater (30.5 cm or greater) center to center as opposed to standard designs using nominal short radius bends with 8 inches (20 cm) center to center. It will be appreciated that conventional "short radius" 180 degree return bends measure two times nominal diameter center to center. Thus, in a non-limiting example, 4" (10 cm) nominal tubes, short radius return bend is 8 inches (20 cm) center to center. Short radius tubes are generally used in "straight in line" radiant sections. Conversely, conventional "long radius" 180 degree return bends are considered to measure 3 nominal diameters center to center. Thus, for 4" (10 cm) nominal tubes, this dimension is 12 inches (30.5 cm). This ability gives several advantages. Lower pressure means more process fluid vaporization of cracked product, increasing velocity in the bottom tubes and reducing the duration of retention or residence time in the furnace at which the fluid temperature is high enough to possibly deposit coke in the heater tubes. Longer radius return bends also can result in lower erosion rates during decoking operations at the same velocities and particle loading, and thus improve coil life.

The staggered tube design of the instant invention also permits a reduction in height and volume of the fire box or radiant heat section of the coking furnace, which reduces cost. The fire box could be reduced in size about one-third to about one-fourth of the typical, conventional size, depending on the exact embodiment of the invention used. A shorter fire box is more efficient because there is less surface area and less heat loss. Fabrication costs would be reduced due to using less material. The costs for the foundation of the coking furnace would also be reduced since the coking furnace would weight less.

The invention will be described in more detail with respect to certain non-limiting embodiments shown in the Figures. FIG. 1 shows a refining process 100 including a coker. The crude oil is taken from the crude oil storage tank 1 and pumped through the initial crude heater 2. It is then run through an initial distillation tower 3 where the components are separated into butane and lighter 4, straight run gasoline 5, naphtha 6, kerosene 7, light gas oil 8, heavy oil 9 and straight run residue 10.

The products of the initial distillation are then further refined, used in other processes, or stored until shipped to a purchaser. The straight run residue 10 is pumped to the coker heater 11. Inside the coking furnace 11, straight run residue 10 is heated to a temperature of in between about 800 and about 1000° F. (427-538° C.). Ideally the outlet temperature is about 920° F. (493° C.) at the outlet, in one non-limiting embodiment. From the coking furnace 11 the product is then pumped into one of two coke drums 12 where the coke is allowed to form. The filling of the coke drums 12 is alternated so that once a drum is full it is allowed time to cool and the coke is allowed to solidify inside. The coke is then cut and removed from the coke drum 12. During the cooling and cutting cycle, the feedstock from the coking furnace 11 is fed into the opposite coke drum 12. Residual gases and vapor coming from the coke drums 12 are then taken over to the fractionator 13 which separates the product into $C_4$ and lighter 14, gasoline 15, naphtha 16 and gas oil 17. These products are then piped onto further processing, stored or used to operate the refinery.

Figure 2:
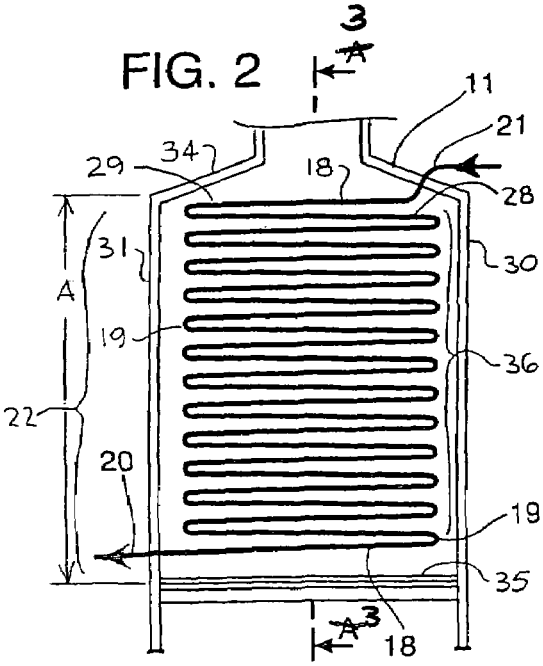
FIG. 2 is a cross-sectional side view of a coker heater containing an embodiment of the present invention.

FIG. 2 shows a cross-sectional side view of a cracking heater or coking furnace 11 containing the present invention. Coking furnace or coker heater 11 is an enclosed housing having substantially parallel front wall 30 and back wall 31, and a pair of substantially parallel sides 32, 33 (shown in FIG. 3) which are substantially perpendicular to the front 30 and back 31, and a top 34 and bottom 35 thus providing a continuous enclosure. The feedstock enters the coking furnace 11 through the heater inlet (first end) and convection section (not shown) and then to the radiant section 22 inlet 21. Radiant section 22 does not solely transmit heat to the feedstock in tubes 18 by radiant means, but does so predominantly by radiation, and thus this section 22 is termed a radiant section. Feedstock then flows through the radiant section 22 heater tubes 18. The plurality of horizontal heater tubes 18 are connected by a plurality of long radius bends 19 located at the ends of the heater tubes 18. The end of a heater tube 18 toward the front wall 30 is a front end 28, and the heater tube 18 end toward the back wall 31 is a back end 29. As noted, the generally horizontal heater tubes 18 are sequentially linked by the tube bends 19. The feedstock then leaves the coking furnace 11 at the heater outlet (second end) 20. The overall height of the coking furnace radiant section 22 of cracking heater structure 11 is shown as dimension A. The alternate tube arrangement of the invention permits A to be reduced from that of a conventional coking furnace. Although FIG. 2 shows that the feedstock enters the top of the coking furnace 11 (heater inlet 21 is at the top) and exits the bottom of the coking furnace 11 (outlet 20 is at the bottom), the invention is not necessarily limited to this configuration, although this is the more conventional flow direction. It is anticipated that the invention could be used in a design where the feedstock flows the other direction.

Figure 3:
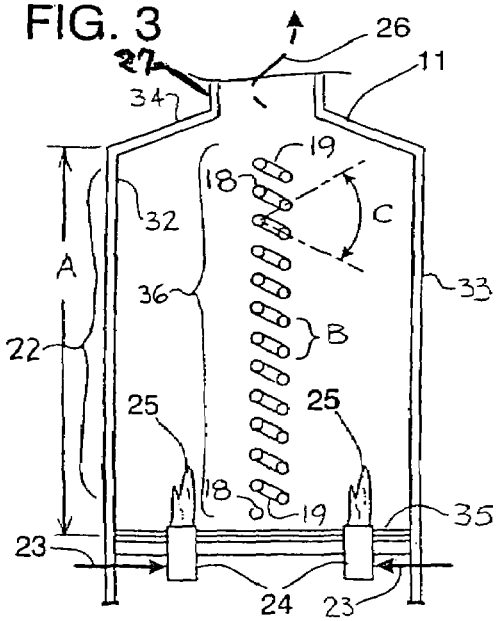
FIG. 3 is a cross-sectional front view of a coker heater containing an embodiment of the present invention.
Figure 6:
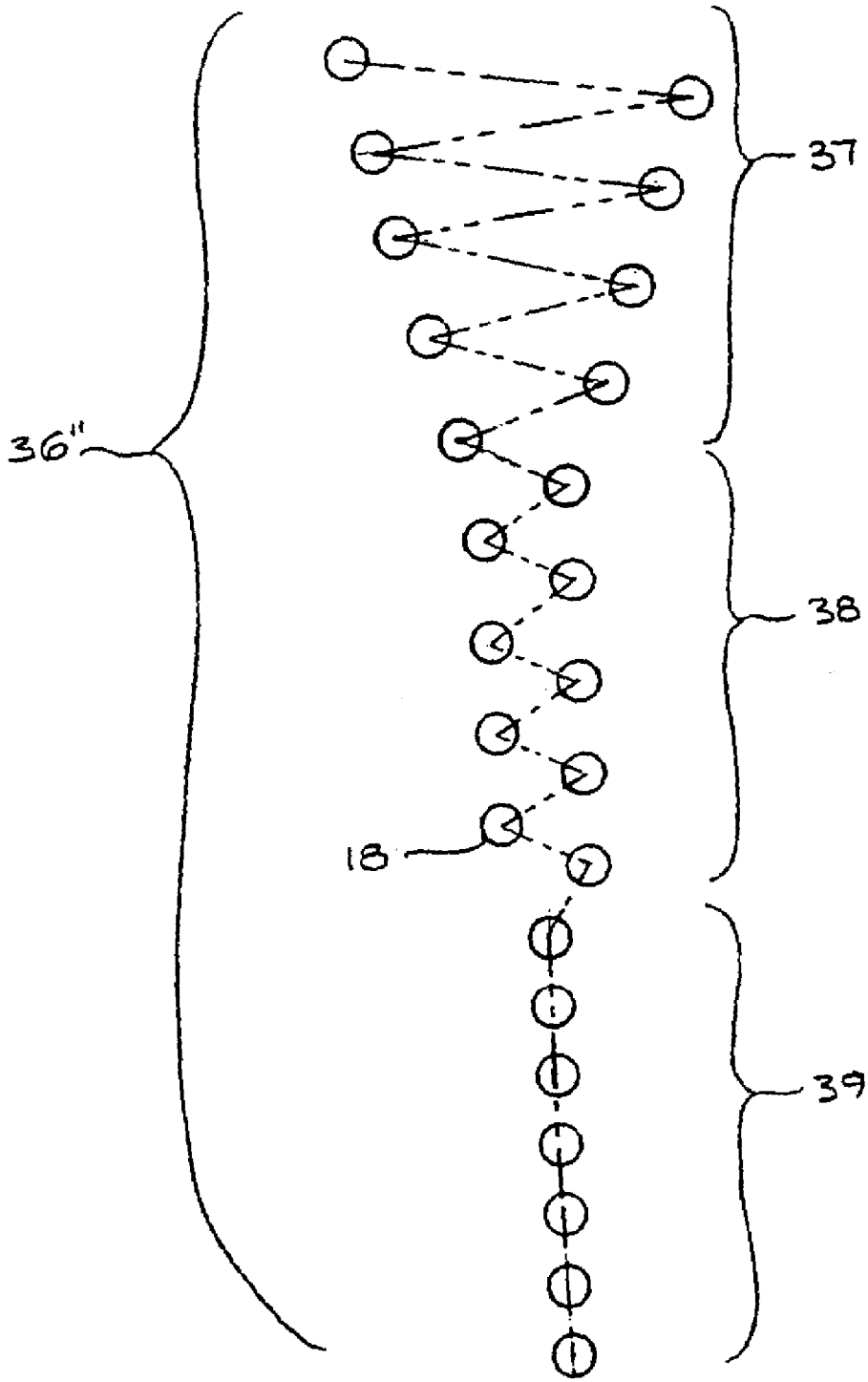
FIG. 6 is a diagram of one embodiment of a tube layout within a coking furnace according to the present invention showing portions of different arrangements.

FIG. 3 shows a cross-sectional view of a coking furnace 11 containing the present invention. The heater tubes 18 and the long radius bends 19 which connect them are located in the center of the coking furnace 11 in two vertical columns, although it will be appreciated that the invention anticipates a plurality of vertical columns, not necessarily only two. It will further be appreciated that the vertical columns of tubes 18 are not necessarily strictly vertical but are only generally vertical in arrangement. For instance, the tube bundle portion 37 shown in the upper part of FIG. 6 are within the scope of the invention, even though they are not truly vertical. The heater tubes are generally parallel to the sides 32 and 33 of the coking furnace 11. The heater tubes 18 as viewed "end on" in FIG. 3 are horizontally and vertically displaced from the heater tubes 18 in the other column, and thus have a "staggered" configuration with respect to each other. The particular heater tubes 18 in FIG. 3 are shown with a 12-inch (30.5 cm) displacement B between 4" (10 cm) diameter heater tubes 18 and the long radius bends are at a 60° angle C from each other. In other words, an angle C is formed between the center of one tube 18 as the vertex extending to the two closest tubes 18 in the vertical column adjacent the tube (but displaced vertically and horizontally therefrom to give the "staggered" appearance), where the angle C is less than 180°. If C was zero degrees, the tubes are fully side-by-side, and if C was 180 degrees C would be current, straight vertical in-line design. A possible preferred version would have an angle range between 80 and 40 degrees. In another non-limiting preferred angle range C may range from about 70° to about 50°. All of the tubes 18 may be collectively known as a tube bundle 36.

Also shown in FIG. 3 are burners 24 and flames 25 located on each side of the tube bundle, between the tube bundle and the side walls 32 and 33 of the coking furnace 11. The burners 24 are supplied with fuel by the fuel lines 23. The flue gas 26 from the burners 24 is shown exiting the coking furnace radiant section 22 of coking furnace 11 via exhaust duct 27 typically to the coking furnace 11 convection section. Exhaust duct 27 is any channel or mechanism or device useful in removing flue gas 26 from the coking furnace 11 and need not be a conventional duct having a rectangular cross-section.

It will be appreciated that in the particular embodiments shown in FIGS. 2 and 3 that the tube bundle 36 is in the radiant heating section 22 of the coking furnace 11.

Figure 4:
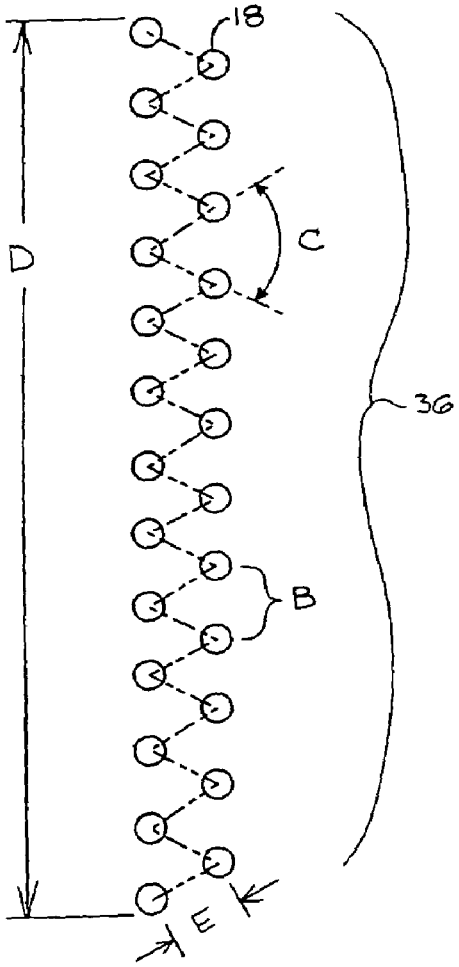
FIG. 4 is a diagram of one tube layout within a coking furnace according to the present invention in a non-limiting embodiment.

FIG. 4 shows the tube bundle 36 of twenty-five (25) heater tubes 18 in accordance with the present invention. As discussed with respect to FIG. 3, the angle between the long radius bends 19 is indicated by C. The spacing between the heater tubes 18 is indicated by dimension B. FIG. 4 was drawn to scale to show an angle C of 60° and spacing B of 12 inches (30.5 cm) with 4 inch (10 cm) diameter heater tubes 18, in one non-limiting embodiment.

Figure 5:
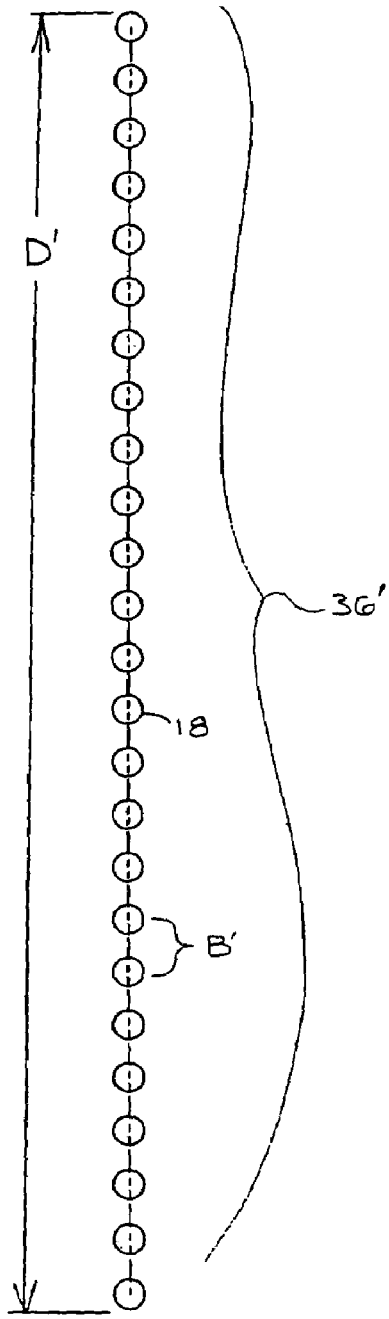
FIG. 5 is a diagram of the tube layout within a coking furnace according to the prior art using the same number of tubes as in FIG. 4.

FIG. 5 shows a heater tube 18' arrangement of the prior art drawn to the same scale as FIG. 4 and also using 25 tubes. FIG. 5 is additionally drawn to show 4 inch (10 cm) diameter heater tubes 18' with a spacing B' of 8 inches (20 cm). It will be appreciated that using the alternate coking furnace tube arrangement of the invention shown in FIG. 4 with two offset vertical columns that an appreciably shorter tube bundle containing the same number of tubes 18 would occupy about 148 inches (3.76 m) of vertical height D. In contrast, where tubes 18' are arranged in one vertical column as is conventional, the tube bundle 36' has a vertical height D' of about 196 inches (4.98 m). Stated another way, using the alternate tube arrangement of the invention, the vertical height of the tube bundle 36' can be reduced to approximately 75% of its initial height.

It will be appreciated that staggering or offset positioning of the tubes 18 permits the size of the coking furnace 11 to be reduced, and also increases the radiant heat transfer to the upper tubes 18 in the tube bundle 36 by bringing these tubes closer to the heat source. Alternatively, the coking furnace 11 may not have to be fired as hard to heat the feedstock. As discussed above, an overall effect of the inventive arrangement of the heating tubes 18 is to decrease the rate of undesirable coking or deposition of solids within the tubes 18.

Additionally, as noted, the inventive tube arrangement permits the use of longer radius tube bends. In the to-scale drawing of FIG. 4, not only is dimension B, the vertical distance between tubes 18 in a vertical column greater (12" or 30.5 cm in this non-limiting example), but the distance E between the tubes 18 taken along the direction of the tube bend 19 is also 12" (30.5 cm) in this non-limiting example). That is, the radius of the tube bend 19 can be larger, such as 12" (30.5 cm) or more. It will be appreciated, however, that it is not necessary for dimension B and dimension E to be equal. It just happens that in the embodiment of the invention shown in FIGS. 3 and 4 looking at the tube bundle 36 and tubes 18 in cross-section the tubes 18 form a vertical column of alternating equilateral triangles where not only is angle C 60°, but all angles of the three nearest tubes 18 are also 60°.

For instance, it is entirely possible that distance E could be 16 inches (40.6 cm) for an even longer radius tube bend 19, but distance B between adjacent tubes 18 in one of the vertical columns to still be 12 inches (30.5 cm). In this embodiment, angle C would be less than 60° (about 44°). The triangles formed by tubes 18 would not be stacked, alternating equilateral triangles, but rather stacked, alternating isosceles triangles.

In the foregoing specification, the invention has been described with reference to specific embodiments thereof, and is expected to be effective in providing methods and apparatus for heating coking feedstock in a coking furnace with an alternate heating tube arrangement that is more efficient and less prone to coke deposition in the tube bundle. However, it will be evident that various modifications and changes can be made thereto without departing from the broader spirit or scope of the invention as set forth in the appended claims. Accordingly, the specification is to be regarded in an illustrative rather than a restrictive sense. For example, specific combinations of conventionally arranged, single-column planar serpentine tube bundles with double vertical staggered columns of tubes in accordance with this invention may be used. Further, tube bundles having different dimensions B, C, D, and E from those illustrated and discussed may be used. Indeed, it will be appreciated that these dimensions may vary within the same tube bundle design and that the overall tube bundle would still be within the scope of the invention as claimed. It is possible to envision a tube bundle where each progressive tube bend increases in diameter along the flow path as the feedstock temperature increases, or conversely decreases. For instance, FIG. 6 illustrates one non-limiting example of a tube bundle 36" in accordance with this invention that has the same number of tubes (25) as in FIGS. 4 and 5, where there is an upper tube bundle portion 37 with tube bends 19 of varying radii. Within such a portion, dimensions B, C, D, and E would change with each pair of adjacent tubes 18. Within the same bundle 36", middle tube bundle portion 38 with tube bends 19 of same radii in two straight columns would be similar to the embodiment shown in FIG. 4, where as tube bundle portion 39 with tubes 18 in conventional single column as is in conventional as shown in FIG. 5.

I claim:

1. A process for heating a feedstock comprising providing a cracking heater having:

an enclosed housing comprising a substantially parallel front and back, a pair of substantially parallel sides, which are perpendicular to the front and back and a top and bottom providing a continuous enclosure, at least one heat source, an exhaust duct, and a tube bundle comprising a plurality of continuous horizontal tubes parallel to the pair of sides, the horizontal tubes sequentially linked together by a plurality of tube bends and where at least a portion of the tubes are arranged in a plurality of vertical columns and are horizontally and vertically offset from one another; and carrying a feedstock through the tubes beginning at a first end of the tube bundle and exiting at a second end of the tube bundle.

2. The process of claim 1 where carrying the feedstock through the tubes is accomplished beginning at the top of the tube bundle and exiting at the bottom of the tube bundle.

3. The process of claim 1 where in providing the cracking heater, the portion of the tubes in the plurality of vertical columns, an angle C is formed between the center of one tube as the vertex extending to the two closest tubes in the vertical column adjacent the tube, where the angle C is less than 180°.

4. The process of claim 1 further comprising maintaining the cracking heater by cleaning out coke deposited inside the tubes where the maintaining is performed at a time interval less frequently than on identical number of identical tubes in a cracking heater where all of the tubes are arranged in a single vertical column operated at identical temperature.

5. The process of claim 1 where in providing the cracking heater, the tubes have a nominal radius and where the tube bends have a radius of greater than twice the nominal radius.

6. The process of claim 1 where in providing the cracking heater, cracking heater has a height which is less than the height of a cracking heater where all of the tubes are arranged in a single vertical column.

7. The process of claim 1 where in providing the cracking heater, the heat transfer to the feedstock is more efficient as compared with the heat transfer in a cracking heater where all of the tubes are arranged in a single vertical column operated at identical temperature.

* * * * *